US011538651B2

(12) United States Patent
Yun et al.

(10) Patent No.: US 11,538,651 B2
(45) Date of Patent: Dec. 27, 2022

(54) METHOD FOR MANUFACTURING ELECTRIC FIELD EMISSION DEVICE

(71) Applicant: ELECTRONICS AND TELECOMMUNICATIONS RESEARCH INSTITUTE, Daejeon (KR)

(72) Inventors: Ki Nam Yun, Daejeon (KR); Yoon-Ho Song, Daejeon (KR); Jun-Tae Kang, Daejeon (KR); Jeong-Woong Lee, Daejeon (KR); Jin-Woo Jeong, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 0 days.

(21) Appl. No.: 17/562,801

(22) Filed: Dec. 27, 2021

(65) Prior Publication Data

US 2022/0208501 A1 Jun. 30, 2022

(30) Foreign Application Priority Data

Dec. 28, 2020 (KR) ..... 10-2020-0185029
Dec. 14, 2021 (KR) ..... 10-2021-0179102

(51) Int. Cl.

| | |
|---|---|
| ***H01J 9/18*** | (2006.01) |
| ***B08B 7/00*** | (2006.01) |
| ***H01J 9/02*** | (2006.01) |
| ***H01J 35/06*** | (2006.01) |

(52) U.S. Cl.
CPC ..... *H01J 9/18* (2013.01); *B08B 7/0028* (2013.01); *H01J 9/025* (2013.01); *H01J 35/065* (2013.01)

(58) Field of Classification Search
CPC .. H01J 9/18; H01J 9/025; H01J 35/065; H01J 2209/0223; H01J 9/042; B08B 7/0028
See application file for complete search history.

(56) References Cited

U.S. PATENT DOCUMENTS

| | | | | |
|---|---|---|---|---|
| 10,566,167 | B2 | 2/2020 | Lee et al. | |
| 2014/0185777 | A1 | 7/2014 | Liu et al. | |
| 2015/0146865 | A1 | 5/2015 | Kim et al. | |
| 2015/0216025 | A1 | 7/2015 | Jeong et al. | |
| 2019/0304731 | A1* | 10/2019 | Jeong | H01J 1/3048 |

FOREIGN PATENT DOCUMENTS

| | | | |
|---|---|---|---|
| KR | 10-2018-0113374 | A | 10/2018 |
| KR | 10-2019-0033669 | A | 4/2019 |
| KR | 10-2020-0096119 | A | 8/2020 |

* cited by examiner

*Primary Examiner* — Anne M Hines
*Assistant Examiner* — Jose M Diaz
(74) *Attorney, Agent, or Firm* — Rabin & Berdo, P.C.

(57) ABSTRACT

Provided is a method for manufacturing an electric field emission device. The method for manufacturing the electric field emission device includes winding a carbon nanotube yarn around outer circumferential surfaces of a metal plate in a first direction, pressing both side surfaces of the metal plate through a pair of metal structures, wherein a top surface of the metal plate is exposed from the metal structures, and an area of the top surface of the metal plate is less than that of each of both the side surfaces of the metal plate, and cutting the carbon nanotube yarn at an edge portion of the top surface of the metal plate in the first direction to form a plurality of emitters.

10 Claims, 10 Drawing Sheets

METHOD FOR MANUFACTURING ELECTRIC FIELD EMISSION DEVICE

CROSS-REFERENCE TO RELATED APPLICATIONS

This U.S. non-provisional patent application claims priority under 35 U.S.C. § 119 of Korean Patent Application No. 10-2020-0185029, filed on Dec. 28, 2020, the entire contents of which are hereby incorporated by reference.

BACKGROUND

The present disclosure herein relates to a method for manufacturing an electronic field emission device.

Nanomaterials used as emitters may emit electrons to the outside of nanomaterials through a quantum tunneling effect caused by external electric fields. For the effective occurrence of the electron emission process, a tip of the emitter has to have a sharp shape. Therefore, nanomaterials, each of which has a thin and long shape, are widely used for an emitter of the electric field emission device. For example, nanomaterials such as carbon nanotubes (CNT) may be used for the emitter of the electric field emission device. In the case in which the tip of the emitter has the sharp shape, electric fields may be concentrated into the tip of the emitter to improve electron emission efficiency. Recently, as electric field emission devices such as X-ray tubes, which require high-current emitter characteristics, are widely used throughout the industry, studies on an emitter, which has an advantageous structure for electric field emission, is easy to be manufactured, and has excellent durability, and an electric field emission device including the same are being actively conducted.

SUMMARY

The present disclosure provide a method for manufacturing an electric field emission device having improved reliability.

Technical objects to be solved by the present invention are not limited to the aforementioned technical objects and unmentioned technical objects will be clearly understood by those skilled in the art from the specification and the appended claims.

An embodiment of the inventive concept provides a method for manufacturing an electric field emission device, the method including: winding a carbon nanotube yarn around outer circumferential surfaces of a metal plate in a first direction; pressing both side surfaces of the metal plate through a pair of metal structures, wherein a top surface of the metal plate is exposed from the metal structures, and an area of the top surface of the metal plate is less than that of each of both the side surfaces of the metal plate; and cutting the carbon nanotube yarn at an edge portion of the top surface of the metal plate in the first direction to form a plurality of emitters.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Embodiments of the present invention will be described with reference to the accompanying drawings so as to sufficiently understand constitutions and effects of the present invention. The present disclosure may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims. In the accompanying drawings, the components are shown enlarged for the sake of convenience of explanation, and the proportions of the components may be exaggerated or reduced for clarity of illustration.

FIGS. 1, 3, 4, 6, and 8 are schematic perspective views illustrating a process of manufacturing an electric field emission device according to embodiments of the inventive concept.

Figure 1:
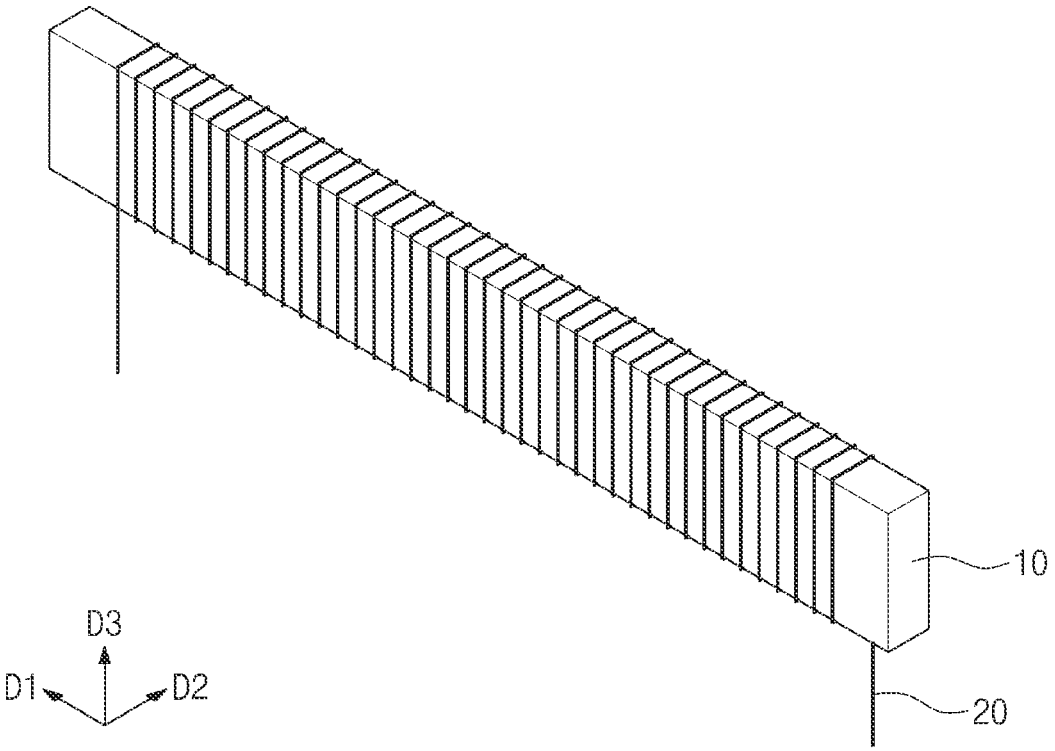
FIGS. 1, 3, 4, 6, and 8 are schematic perspective views illustrating a process of manufacturing an electric field emission device according to embodiments of the inventive concept.

Referring to FIG. 1, a carbon nanotube yarn 20 may wind outer circumferential surfaces of a metal plate 10 along a first direction D1. For example, the carbon nanotube yarn 20 may be spirally wound along the outer circumferential surfaces of the metal plate 10 at regular intervals.

The outer circumferential surfaces of the metal plate 10 may include a top surface, a bottom surface, and both side surfaces connecting the top surface to the bottom surface. An area of each of the top and bottom surfaces of the metal plate 10 may be less than that of each of the side surfaces.

The top surface of the metal plate 10 may have a first length in the first direction D1. The top surface of the metal plate 10 may have a second length in a second direction D2 that is parallel to the top surface and crosses the first direction D1. The second length of the metal plate 10 may also be referred to as a thickness of the metal plate 10. For example, the top surface of the metal plate 10 may have a rectangular structure in which the first length is greater than the second length. The metal plate 10 may have a height in a third direction D3 that is perpendicular to the top surface, and the height may be less than the first length, but greater than the second length.

Figure 2:
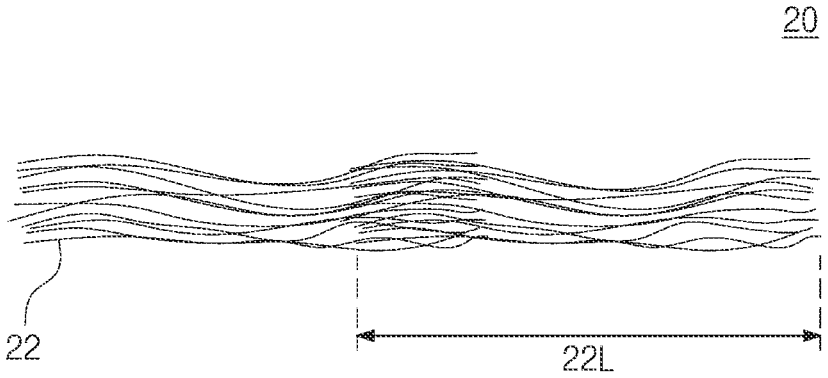
FIG. 2 is a conceptual view illustrating a carbon nanotube yarn of FIG. 1.

FIG. 2 is a conceptual view illustrating the carbon nanotube yarn 20 of FIG. 1.

The carbon nanotube yarn 20 may have a form in which carbon nanotube bundles 22 are entangled like fibers. For example, the carbon nanotube bundles 22 may be combined to form the carbon nanotube yarn 20. A diameter of each of the carbon nanotube bundles 22 may range of about 1 μm to about 10 μm, and a length 22L may range of about 1 μm to about 2 cm.

Figure 3:
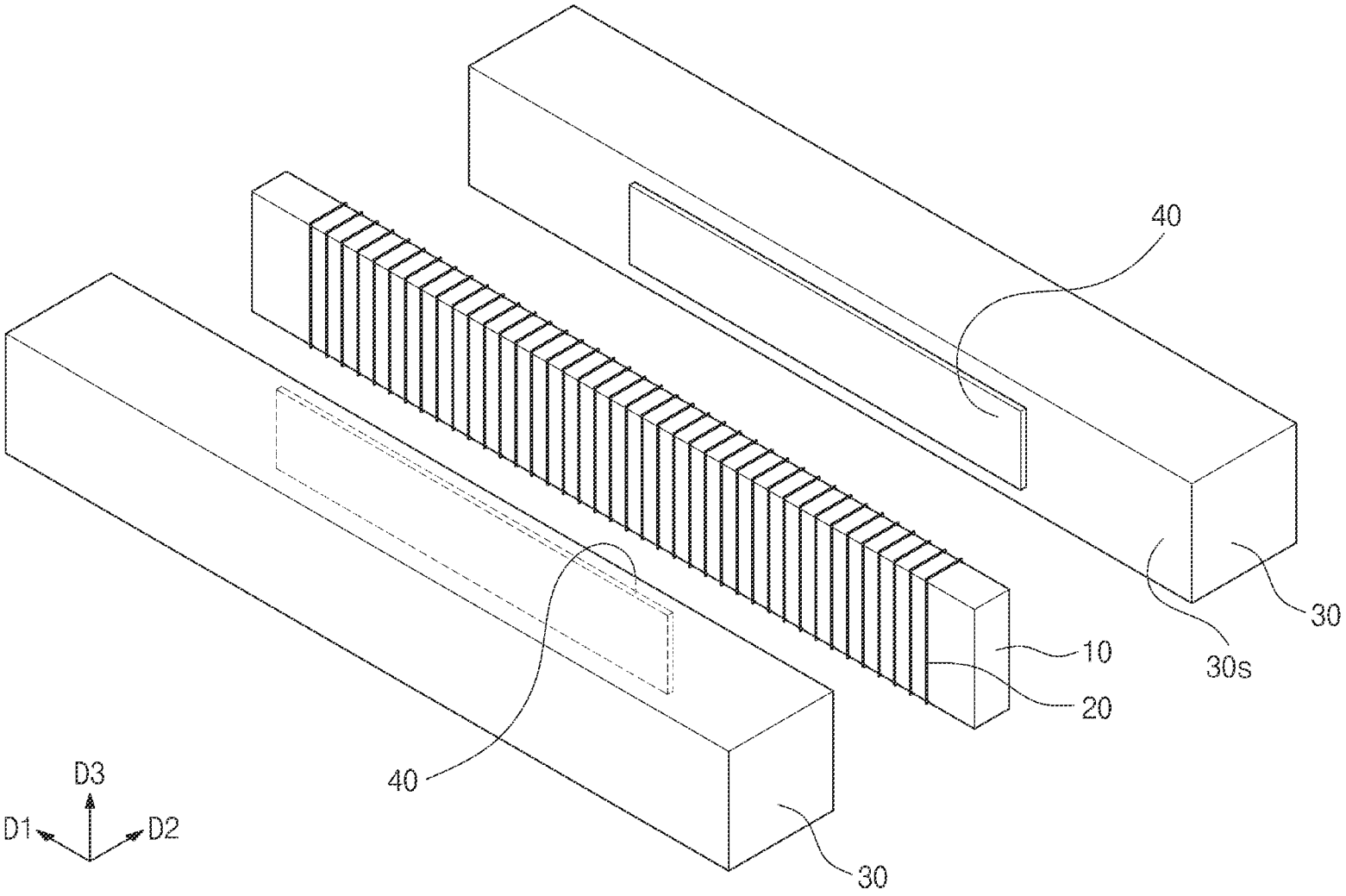

Referring to FIG. 3, a pair of metal structures 30 may be provided on both sides with the metal plate 10 therebetween. Each of the metal structures 30 may be in a state in which a conductive filler 40 is applied to a surface 30*s* that is adjacent to the metal plate 10. The conductive filler 40 may include a brazing welding material, for example, silver, copper, or the like.

Figure 4:
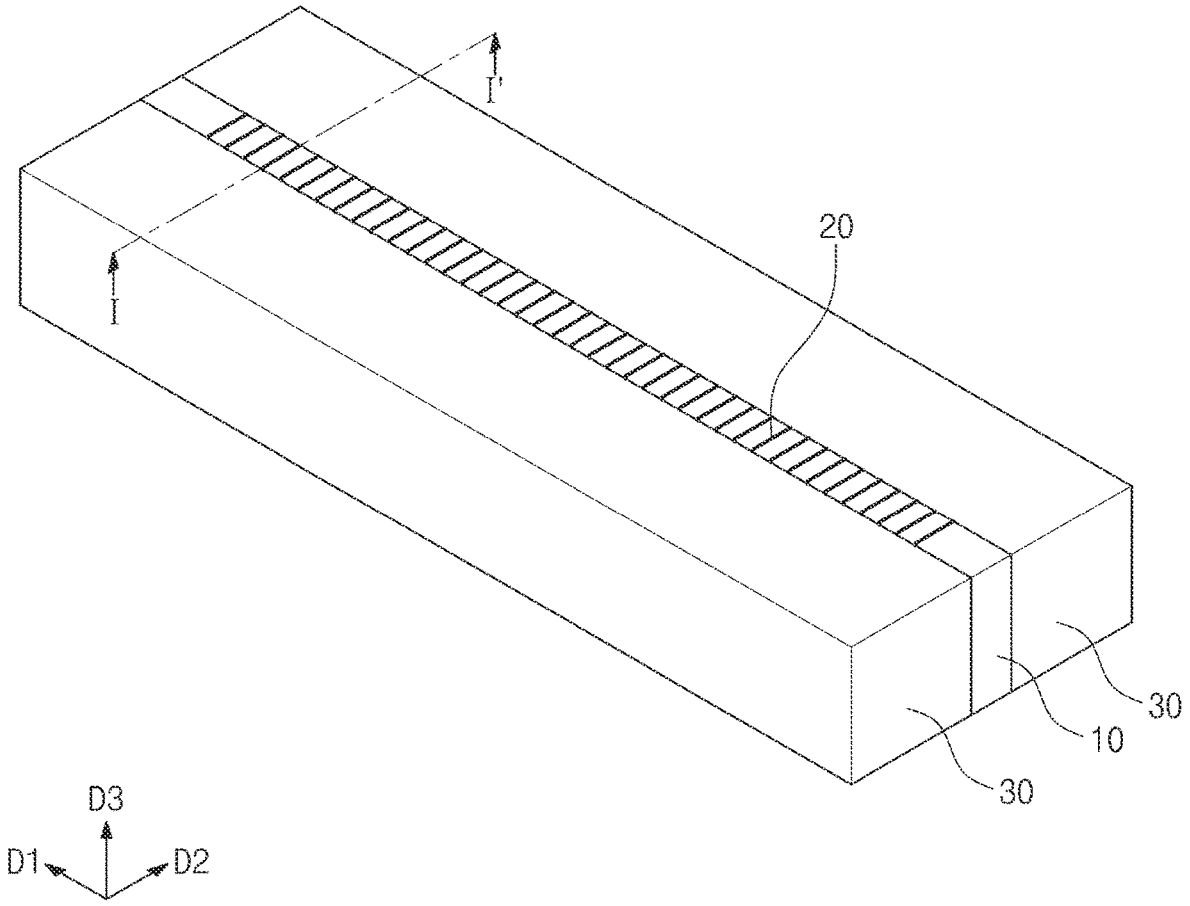
Figure 5:
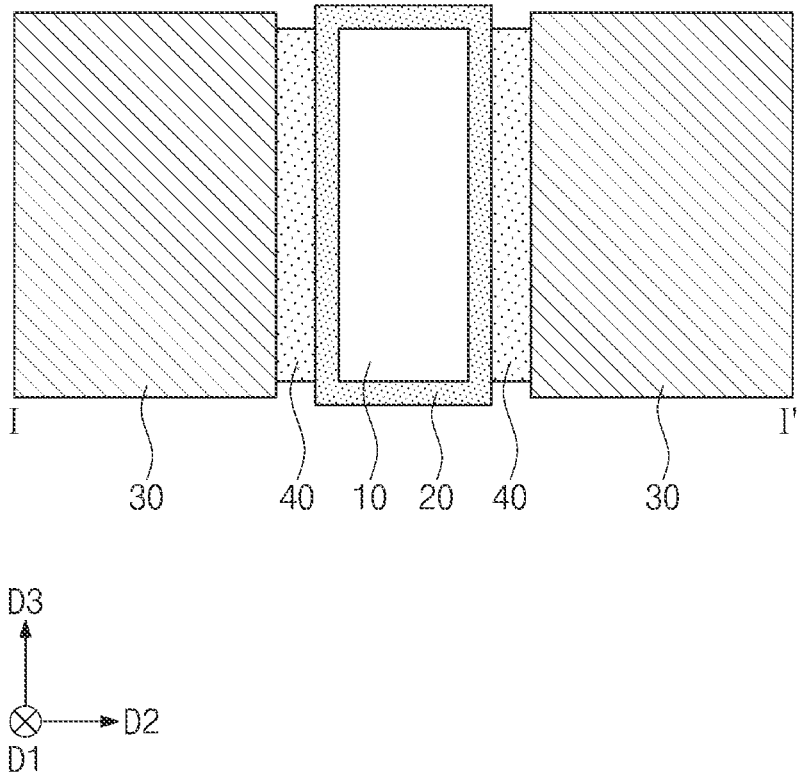
FIG. 5 is a cross-sectional view taken along line I-I' of FIG. 4.

FIG. 5 is a cross-sectional view taken along line I-I' of FIG. 4.

Referring to FIGS. 4 and 5, a pressure may be applied to the pair of metal structures 30 to fix the metal plate 10. In the process of applying the pressure, the metal plate 10 and the carbon nanotube yarn 20 may be in contact with the conductive filler 40. In terms of the cross-sectional area, the metal plate 10 may have a rectangular shape having four surfaces, and the carbon nanotube yarn 20 may surround the four surfaces.

The top and bottom surfaces of the metal plate 10 may be exposed from the pair of metal structures 30. The carbon nanotube yarn 20 may have a line shape extending in the second direction D2 to provide the form of patterns spaced apart from each other in the first direction D1 on the top and bottom surfaces.

Figure 6:
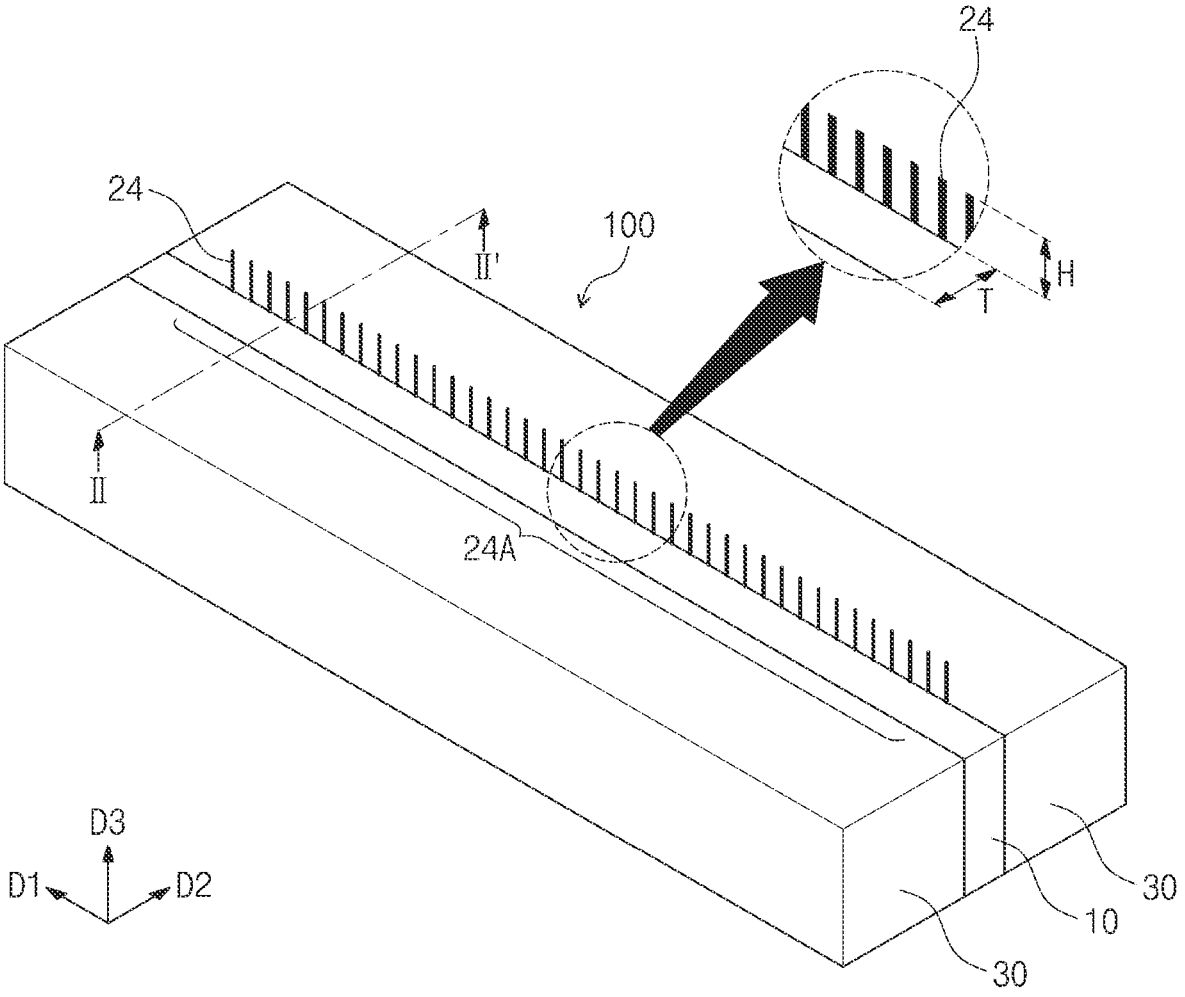
Figure 7:
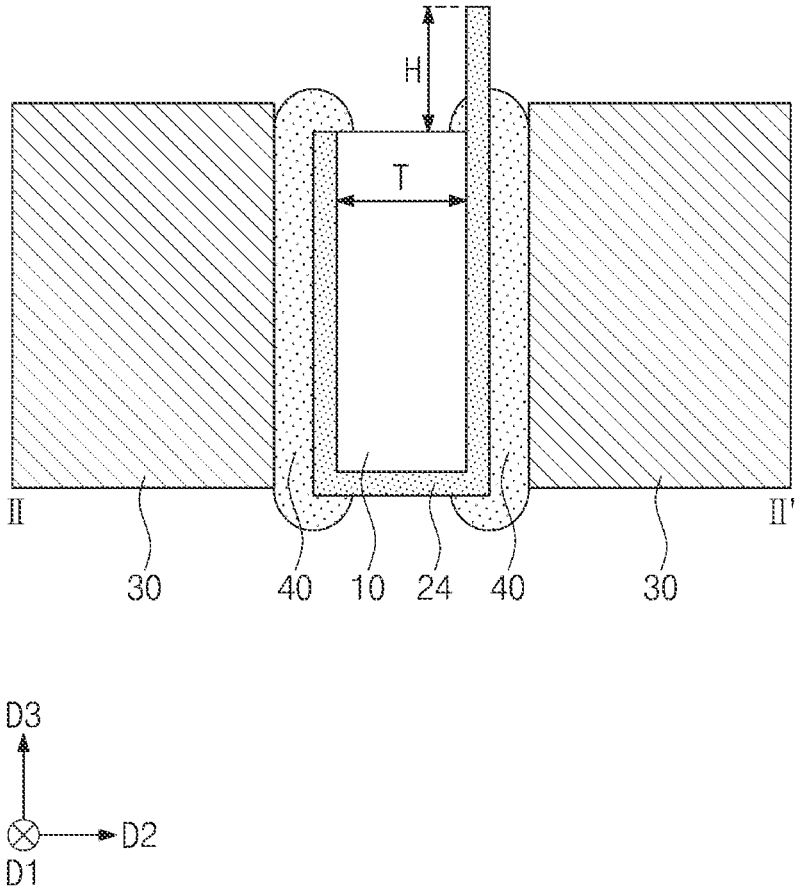
FIG. 7 is a cross-sectional view taken along line II-II' of FIG. 6.

Referring to FIG. 6, the carbon nanotube yarn 20 of FIG. 5 on the top surface of the metal plate 10 may be cut along the first direction D1. Specifically, the carbon nanotube yarn 20 may be cut at an edge portion of the top surface of the metal plate 10. The edge portion of the top surface of the metal plate 10 may be disposed to be more adjacent to one of the two metal structures 30 and disposed to be further away from the other metal structure 30. The carbon nanotube yarn 20 may be segmented by the cutting process to provide carbon nanotube yarn patterns.

Then, the segmented carbon nanotube yarn patterns may protrude upward by using an adhesive material such as an adhesive sheet. A portion of each of the carbon nanotube yarn patterns, which protrude above the top surface of the metal plate 10, may be referred to as an emitter 24. A height H of the emitter 24 may be substantially equal to the thickness T of the metal plate 10.

The emitters 24 may be disposed at regular intervals along the first direction D1. The emitters 24 may form an emitter array 24A. As a result, an electric field emission source 100 including the emitter array 24A, the pair of metal structures 30, the metal plate 10, and the conductive filler 40 may be provided.

In a process of attaching and detaching the carbon nanotube yarn patterns and the top surface of the metal plate 10 with the adhesive sheet, some of the carbon nanotube yarn patterns may be removed. Specifically, the carbon nanotube bundles 22, which are not fixed by the metal plate 10 and the metal structures 30, among the carbon nanotube bundles 22 constituting the carbon nanotube yarn patterns may be attached to the adhesive sheet and then removed.

The length 22L of the carbon nanotube bundle 22 of FIG. 2 may be greater than the height H of the emitter 24. The length 22L of the carbon nanotube bundle 22 may be greater 1.5 times or more than the height H of the emitter 24. As a result, the carbon nanotube pattern constituted by the carbon nanotube bundles 22 may be well fixed between the metal structures 30 and the metal plate 10.

Then, the conductive filler 40 may be melted and hardened through heat treatment. The conductive filler 40 may cover non-protruding cut surfaces of the carbon nanotube patterns. In addition, the conductive filler 40 may allow the carbon nanotube patterns to be strongly fixed by the metal plate 10 and the metal structures 30. The electric field emission source 100 may be connected to a cathode electrode (not shown).

Figure 8:
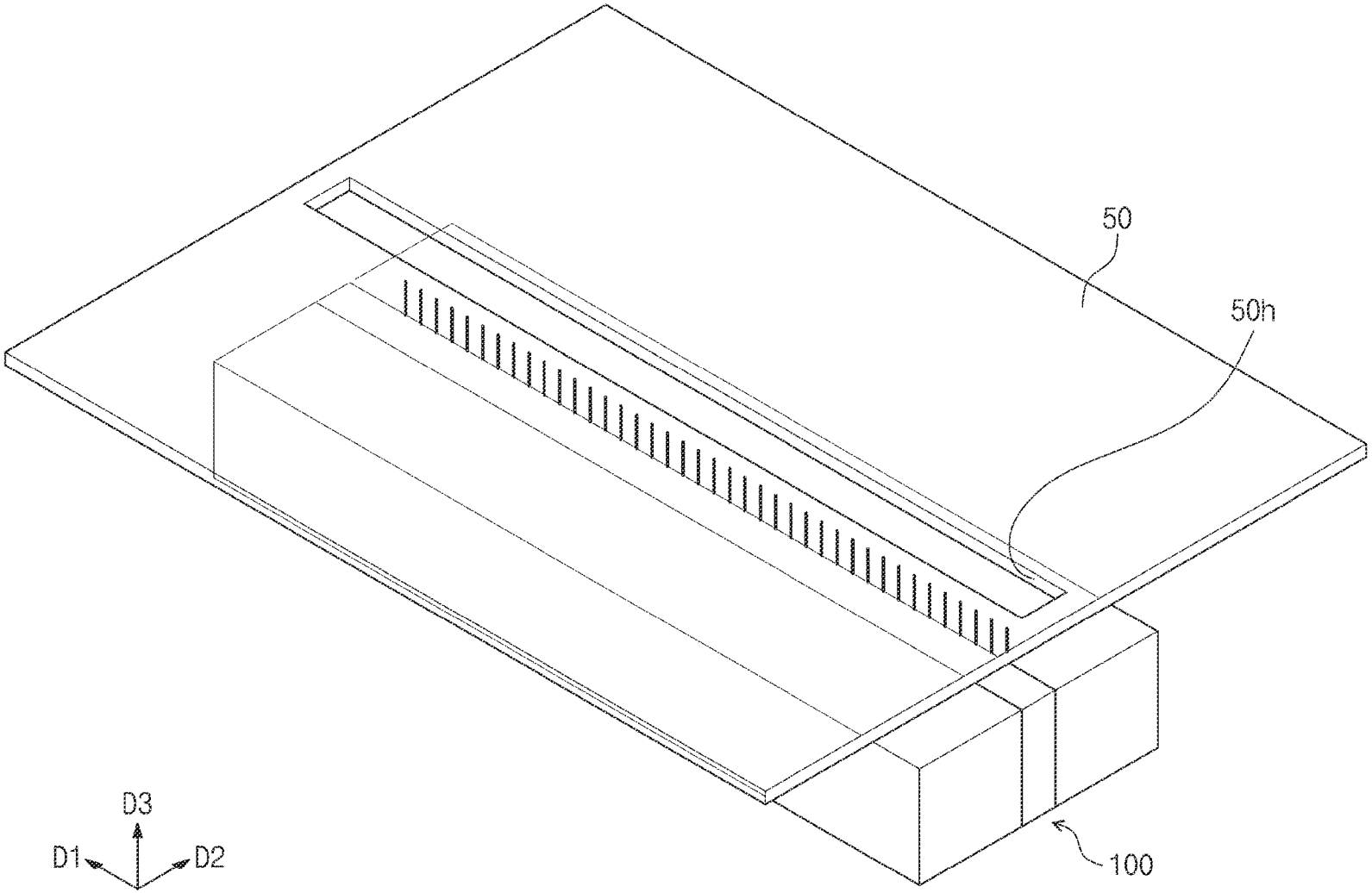

Referring to FIG. 8, a gate electrode 50 may be provided on the electric field emission source 100. The gate electrode 50 may include a gate hole 50*h* through which the emitter array 24A is exposed. The gate hole 50*h* may vertically overlap the emitter array 24A. The gate hole 50*h* may have a slit shape in which a width thereof in the first direction D1 is greater than a width thereof in the second direction D2.

An anode electrode (not shown) may be provided above the gate electrode 50. The electric field emission device including the electric field emission source 100, the cathode electrode, the gate electrode 50, and the anode electrode will be described in detail with reference to FIG. 11.

Figure 9:
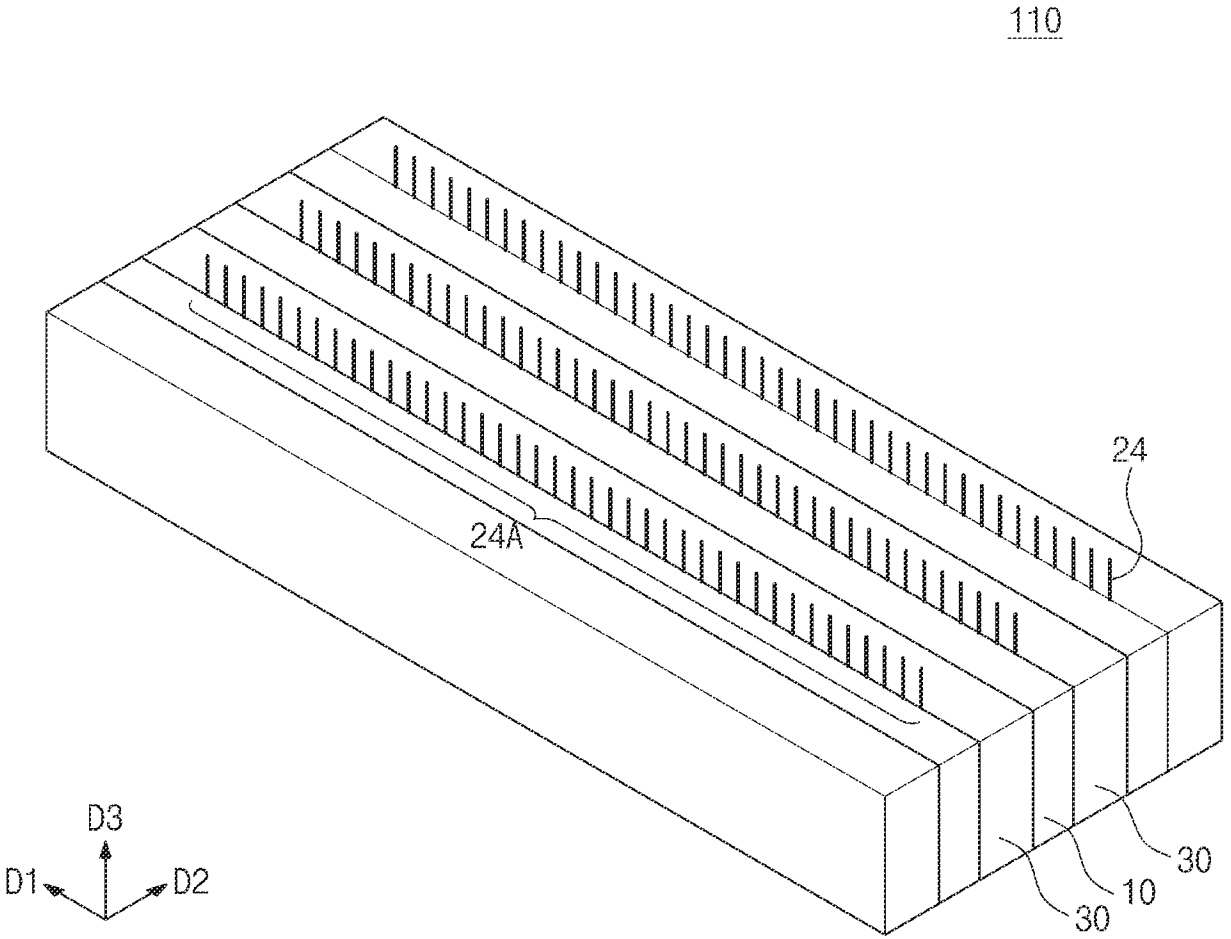
FIGS. 9 and 10 are schematic perspective views illustrating a process of manufacturing an electric field emission device according to some embodiments.
Figure 10:
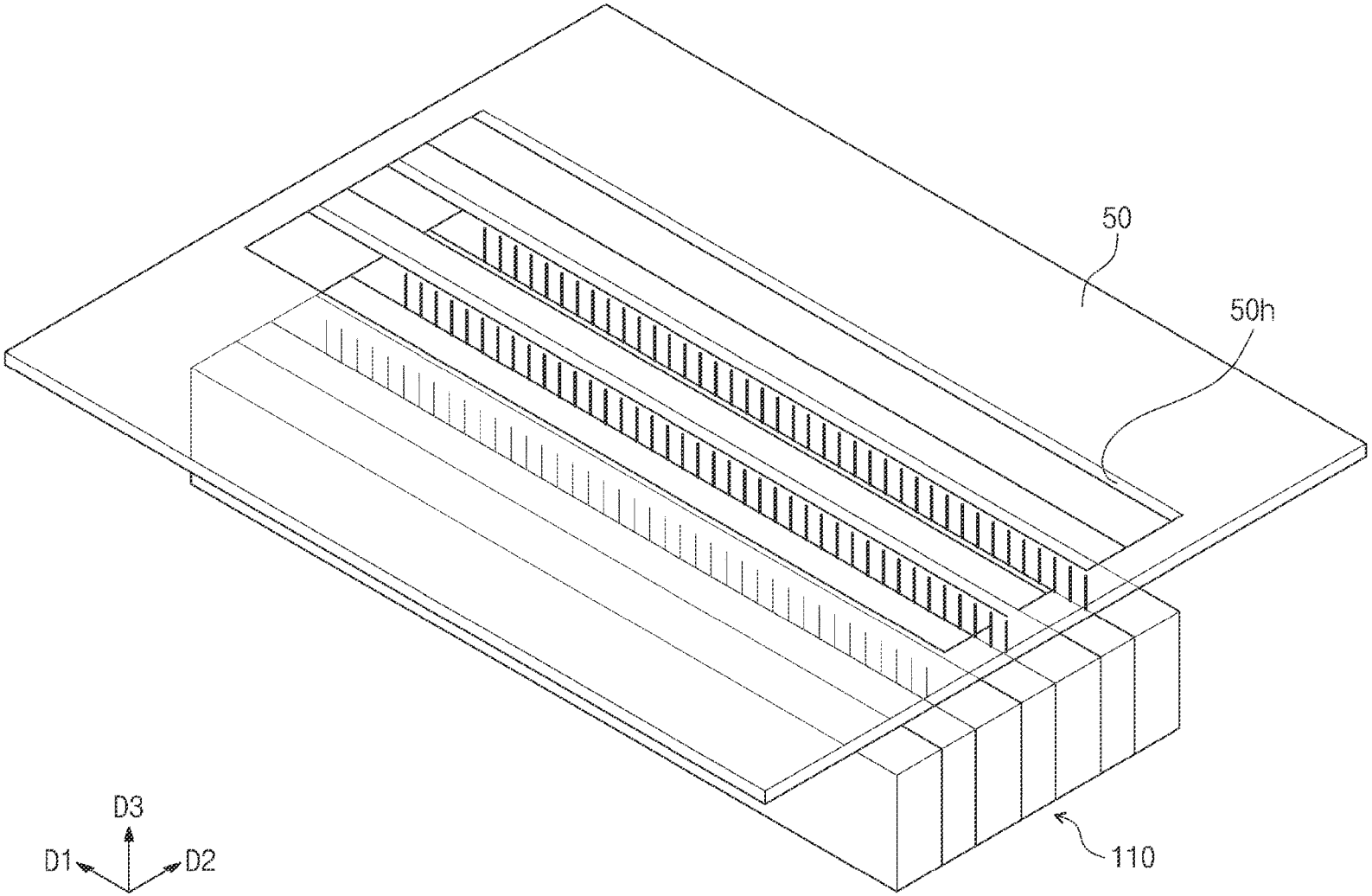

FIGS. 9 and 10 are schematic perspective views illustrating a process of manufacturing the electric field emission device according to some embodiments. Except for those described below, those overlapping with those described with reference to FIGS. 1 to 8 will be omitted.

Referring to FIG. 9, an electric field emission device according to some embodiments may include an electric field emission source 110 including a plurality of metal plates 10 and a plurality of emitter arrays 24A.

The plurality of metal plates 10 may be disposed to be spaced apart from each other in the second direction D2. The metal plates 10 may be fixed by metal structures 30 disposed on both sides. The emitter arrays 24A may be disposed on edge portions of each of top surfaces of the metal plates 10. The emitter arrays 24A may be spaced apart from each other in the second direction D2.

Except for the outermost metal structures 30, a conductive filler 40 may be applied to both side surfaces of the metal structures 30 disposed at the inside. Thus, one side surface of each of the metal structures 30 disposed at the inside may be coupled to any one metal plate 10, and the other side surface may be coupled to the other metal plate 10.

Referring to FIG. 10, a gate electrode 50 may be provided on the electric field emission source 110. The gate electrode 50 may include a plurality of gate holes 50*h*, through which the plurality of emitter arrays 24A are exposed, respectively.

Figure 11:
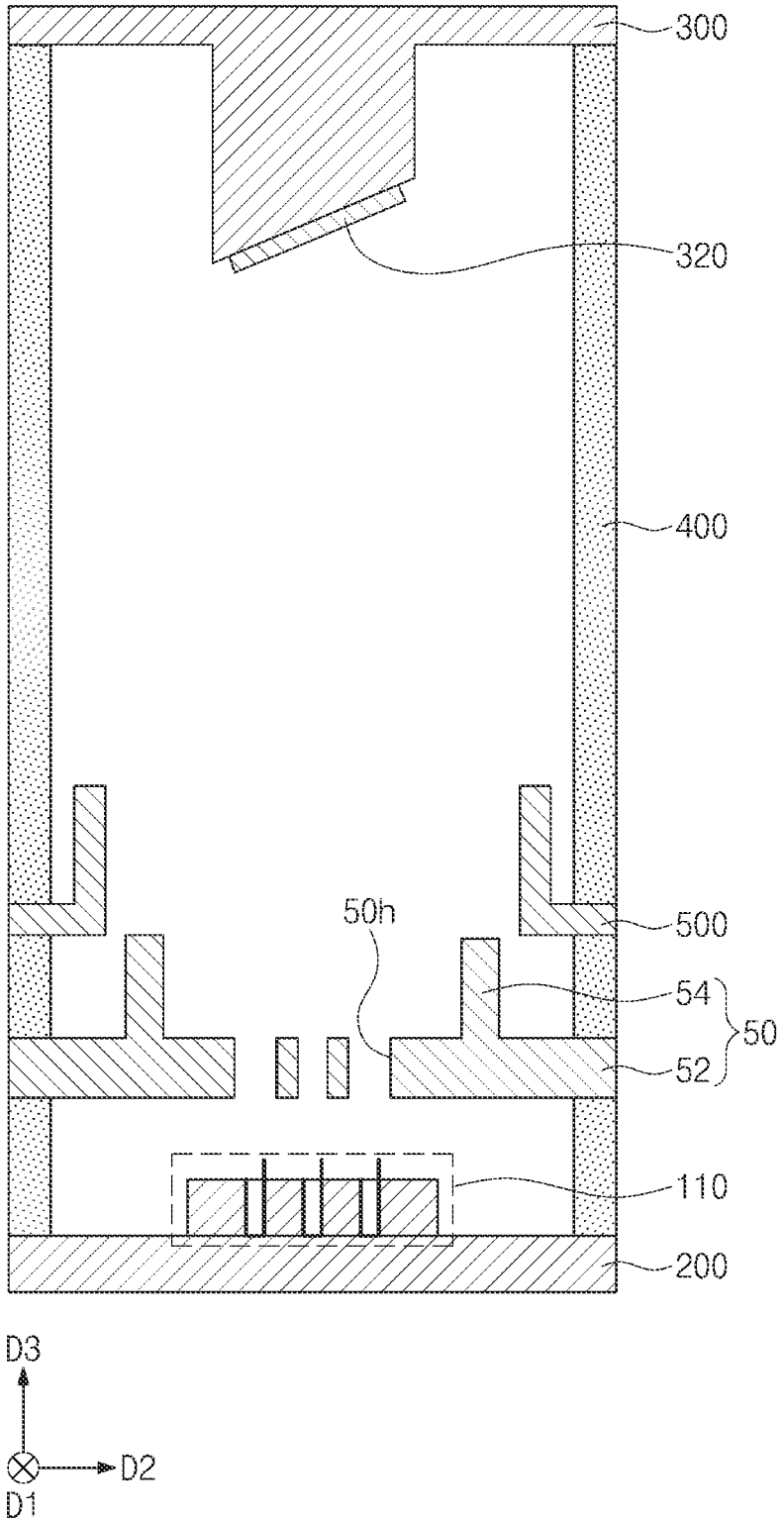
FIG. 11 is a schematic cross-sectional view of an X-ray tube including an electric field emission device.

FIG. 11 is a cross-sectional view for explaining the electric field emission device including an electric field emission source 110 according to embodiments of the inventive concept.

The electric field emission device according to embodiments of the inventive concept includes the electric field emission source 110 of FIG. 9, a cathode electrode 200, a gate electrode 50, an anode electrode 300, a target 320, and a housing 400. The electric field emission source 110 corresponds to a cross section in the second direction D2 of FIG. 9.

The electric field emission source 110 may be provided on the cathode electrode 200. The cathode electrode 200 may include a conductive material, and the conductive material may include a material such as copper (Cu), aluminum (Al), molybdenum (Mo), and the like.

The electric field emission source 110 may be in contact with the cathode electrode 200 or may be coupled to the cathode electrode 200 through a conductive material therebetween.

The cathode electrode 200 and the anode electrode 300 may be spaced apart from each other in the third direction D3. The cathode electrode 200, the anode electrode 300, and the gate electrode 50 may be electrically connected to an external power source (not shown). For example, a positive voltage or a negative voltage may be applied to the cathode electrode 200 or may be connected to a ground power source. A voltage having a potential that is relatively higher than that of the cathode electrode 200 may be applied to the anode electrode 300 and the gate electrode 50.

Each of the anode electrode 300 and the gate electrode 50 may include a conductive material. For example, the conductive material may include a material such as copper (Cu), aluminum (Al), molybdenum (Mo), and the like. The anode electrode 300 may be a rotatable anode electrode 300 rotating in one direction or a fixed anode electrode 300. The gate electrode 50 may be disposed between the electric field emission source 110 and the anode electrode 300. The gate electrode 50 may be disposed adjacent to the electric field emission source 110 rather than the anode electrode 300.

In a plan view, each of the anode electrode 300 and the gate electrode 50 may be provided in a disk shape, but is not limited thereto.

The gate electrode 50 may include a base 52 and a protrusion 54. The base 52 may have a disk shape, and the protrusion 54 may have a hollow cylindrical shape.

The gate electrode 50 may include a plurality of gate holes 51 passing therethrough. The gate holes 51 may vertically overlap an emitter array 24A. Each of the gate holes 51 may have a slit shape as illustrated in FIG. 10.

A voltage may be applied to the metal structure 30 by being electrically connected to the cathode electrode 200. Specifically, the emitter 24 may emit electrons and/or electron beams by electric fields generated by a voltage applied to the cathode electrode 200, the anode electrode 300, and the gate electrode 50.

The electron beam emitted from the emitter 24 may proceed toward the anode electrode 50 through the gate holes 50*h*. The electrons and/or the electron beam emitted from the emitter 24 may be generated and accelerated in a vacuum state.

In the case of the electric field emission device, it is important to maintain an internal vacuum environment for the generation and acceleration of the electron beam. In the case of the related art, since an additional organic adhesive is used in a process of fixing the emitter to the cathode electrode, the maintenance of the internal vacuum environment is somewhat weak. In the case of the present disclosure, since the emitter is fixed using a conductive filler and metal structures without using the organic adhesive, the electric field emission device may be stably driven during the electron emission in the vacuum environment. In addition, the present disclosure may include a process of cutting a carbon nanotube yarn in a first direction after winding the carbon nanotube yarn around an outer circumferential surface of a metal plate at regular intervals along the first direction and a process of surface-treating the cut carbon nanotube yarns using an adhesive tape to form an emitter and remove an unattached carbon nanotube bundle. As a result, arc may be prevented from being generated even at a high voltage to improve reliability of the electric field emission device.

The housing 400 may include an insulating member. The housing 400 may include a solid material even in a vacuum state. For example, the housing 400 may include ceramics or glass based on inorganic compounds such as aluminum oxide and aluminum nitride.

The target 320 may be provided on a bottom surface of the anode electrode 300. The target 320 may be a material that emits X-rays when electron beams collide with each other. The target 320 may include, for example, at least one of molybdenum (Mo), tantalum (Ta), tungsten (W), copper (Cu), or gold (Au).

The electric field emission device may further include a focusing electrode 500 provided between the gate electrode 50 and the anode electrode 300. The focusing electrode 500 serves to adjust a traveling direction of the electron beam.

In the method for manufacturing the electric field emission device according to the embodiments of the inventive concept, the carbon nanotube yarn may be wound around the outer circumferential surface of the metal plate at regular intervals along the first direction. Thereafter, the carbon nanotube yarn may be fixed by pressing both the side surface of the metal plate by using the pair of metal structures. Subsequently, the process of cutting the carbon nanotube yarn in the first direction may be performed. The cut carbon nanotube yarns may be surface-treated using the adhesive tape or the like to form the emitter array and remove the unfixed carbon nanotube yarns. As a result, the arc or the like may be prevented from occurring even at the high voltage to improve the reliability of the electric field emission device.

Although the embodiment of the inventive concept is described with reference to the accompanying drawings, those with ordinary skill in the technical field of the inventive concept pertains will be understood that the present disclosure can be carried out in other specific forms without changing the technical idea or essential features. Thus, the above-disclosed embodiments are to be considered illustrative and not restrictive.

What is claimed is:

1. A method for manufacturing an electric field emission device, the method comprising:

winding a carbon nanotube yarn around outer circumferential surfaces of a metal plate in a first direction;

pressing both side surfaces of the metal plate through a pair of metal structures, wherein a top surface of the metal plate is exposed from the metal structures, and an area of the top surface of the metal plate is less than that of each of both the side surfaces of the metal plate; and cutting the carbon nanotube yarn at an edge portion of the top surface of the metal plate in the first direction to form a plurality of emitters.

2. The method of claim 1, further comprising, before the pressing of the metal plate, applying conductive fillers on one surface of each of the metal structures, wherein the pressing of the metal plate comprises allowing the conductive fillers to be in contact with the carbon nanotube yarn.

3. The method of claim 2, further comprising, after the cutting of the carbon nanotube yarn, melting the conductive fillers through thermal treatment.

4. The method of claim 1, wherein the forming of the plurality of emitters comprises pulling the cut portions of the carbon nanotube yarn in a vertical direction after the cutting of the carbon nanotube yarn to protrude above the top surface of the metal plate.

5. The method of claim 4, wherein the pulling of the cut portions of the carbon nanotube yarn in the vertical direction comprises:

attaching an adhesive tape to the top surface of the metal plate and the cut portions of the carbon nanotube yarn; and separating the adhesive tape from the metal plate.

6. The method of claim 1, wherein each of the emitters has a substantially the same height as a width of the metal plate in a second direction crossing the first direction and parallel to the top surface of the metal plate with respect to the top surface of the metal plate.

7. The method of claim 6, further comprising from the carbon nanotube yarn using carbon nanotube bundles, wherein each of the carbon nanotube bundles has a length that is greater about 1.5 times than the height of the emitter.

8. The method of claim 1, wherein the winding of the carbon nanotube yarn around the outer circumferential surfaces of the metal plate comprises spirally winding the carbon nanotube yarn, and intervals between adjacent portions of the carbon nanotube yarn are substantially constant in the first direction.

9. The method of claim 1, wherein intervals between the plurality of emitters in the first direction are substantially the same.

10. The method of claim 1, wherein the forming of the plurality of emitters comprises, after cutting the carbon nanotube yarn, removing the carbon nanotube yarns, which are not fixed by the metal structures and the metal plate.

* * * * *